US005388654A

United States Patent [19]

Heiss

[11] Patent Number: 5,388,654

[45] Date of Patent: Feb. 14, 1995

[54] GROUND-BORING DEVICE

[76] Inventor: Josef Heiss, Steinbach 9, D-8172 Lenggries, Germany

[21] Appl. No.: 39,773

[22] Filed: Mar. 24, 1993

[30] Foreign Application Priority Data

Mar. 24, 1992 [DE] Germany ..... 9204003[U]

[51] Int. Cl.[6] ..... E04H 17/26; E21B 7/00

[52] U.S. Cl. ..... 175/170; 173/140; 173/184; 173/213

[58] Field of Search ..... 37/350, 330, 189; 175/162, 122, 170, 203, 219, 394; 173/22, 38, 163, 165, 166, 140

[56] References Cited

U.S. PATENT DOCUMENTS

| | | | |
|---|---|---|---|
| 1,360,193 | 11/1920 | Davidson . | |
| 3,022,839 | 2/1962 | Troche | 175/170 X |
| 3,705,632 | 12/1972 | Burke . | |
| 3,976,147 | 8/1976 | Cunningham | 175/170 X |
| 4,387,483 | 6/1983 | Larrabee | 16/114 R |
| 4,753,300 | 6/1988 | Shaw et al. . | |
| 4,961,471 | 10/1990 | Ovens | 175/170 |
| 4,979,578 | 12/1990 | Landry | 175/162 |
| 5,007,492 | 4/1991 | Giroux | 175/170 |

FOREIGN PATENT DOCUMENTS

| | | | |
|---|---|---|---|
| WO81/00427 | 2/1981 | Australia . | |
| 1233110 | 10/1960 | France . | |
| 2557193 | 6/1985 | France . | |
| 6752837 | 3/1969 | Germany . | |
| 1297046 | 6/1969 | Germany . | |
| 1922042 | 11/1969 | Germany . | |
| 6926061 | 12/1969 | Germany . | |
| 7110016 | 7/1971 | Germany . | |
| 2826483 | 1/1980 | Germany . | |
| 3044173 | 7/1982 | Germany . | |
| 8715877 | 3/1988 | Germany . | |
| 4016609 | 11/1991 | Germany . | |
| 1004731 | 9/1965 | United Kingdom . | |
| 139502 | 1/1961 | U.S.S.R. | 37/350 |

*Primary Examiner*—William P. Neuder
*Attorney, Agent, or Firm*—Jacobson, Price, Holman & Stern

[57] ABSTRACT

A ground-boring device with a ground auger, which features a boring spindle driven by an engine-transmission unit. A framework is provided with a travelling gear. On the grip ends of the framework is provided a handgrip arrangement located during operation of the device at roughly the gripping level of a service person and a seating device for mounting of the engine-transmission unit of the ground auger, arranged in a longitudinal direction to the framework at a horizontal distance from the travelling gear. The handgrip arrangement is positioned such that the boring spindle essentially runs vertically so that the seating device permits a swinging of the ground auger in relation to the longitudinal direction of the framework during its penetration into the ground.

11 Claims, 1 Drawing Sheet

GROUND-BORING DEVICE

FIELD OF THE INVENTION

The invention concerns a ground-boring device with a ground auger, which features a boring spindle driven by an engine-transmission unit.

1. Background of the Invention

Portable ground augers with a boring spindle driven by an engine-transmission unit, which can be operated by two service people by means of two straps, have already long existed. Recently, in addition, so-called one-man augers have also become known, which with a decreased weight and decreased capacity are meant to be operational, by means of two handgrips, even by a single service person.

However, one-man augers of this type are suitable only for introducing, if need be, a limited number of holes into the ground. Their operation is too fatiguing for introduction of a greater number of holes. In addition, their operation is also dangerous, particularly on difficult terrain or on slopes, due to the high torque which must be absorbed by the service person.

2. Summary of the Invention

A purpose of the present invention is the creation of a ground-boring device which permits a single service person to introduce even a very large number of holes in the ground without a high expenditure of energy, even if difficult terrain or on slopes.

This purpose is solved by means of a ground-boring device with a ground auger, which features a boring spindle driven by an engine-transmission unit, characterized by a framework provided with a travelling gear, on the end of which framework is provided a handgrip arrangement which during operation of the device is located roughly at the gripping height of the service person and a seating device, arranged on the framework in a longitudinal direction of the framework, at the framework at a horizontal distance from the travelling gear and the handgrip arrangement for mounting the engine-transmission unit of the ground auger, such that the boring spindle essentially runs vertically, whereby the seating device permits a swinging of the ground auger in relationship to the longitudinal direction of the framework for its penetration into the ground.

A preferred design of the invention consists therein, that the travelling gear is arranged on the end of the framework located opposite the end on which the handgrip arrangement is arranged, and that the seating device is located in the middle part of the framework, between the travelling gear and the handgrip arrangement.

Another preferred design of the invention consists therein, that the framework is formed by two longitudinal bars which run in their longitudinal direction diagonally upward from the travelling gear to the handgrip arrangement and which are connected to each other in the vicinity of the travelling gear and the handgrip arrangement by means of crossbars, between which longitudinal bars in their upper region are mounted the seating device, by means of mounting bolts, to be rotatable around an axis running crosswise to the framework.

Other advantageous further designs of the invention are given in the subclaims.

In the following an embodiment example of the invention is explained with the aid of the drawings.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
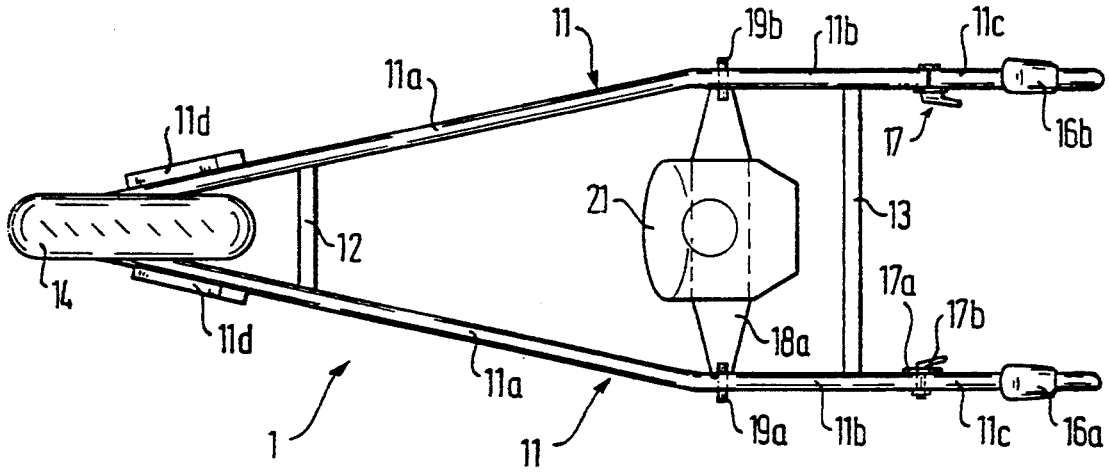
FIG. 1 shows a top view of a ground-boring device according to an embodiment example of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
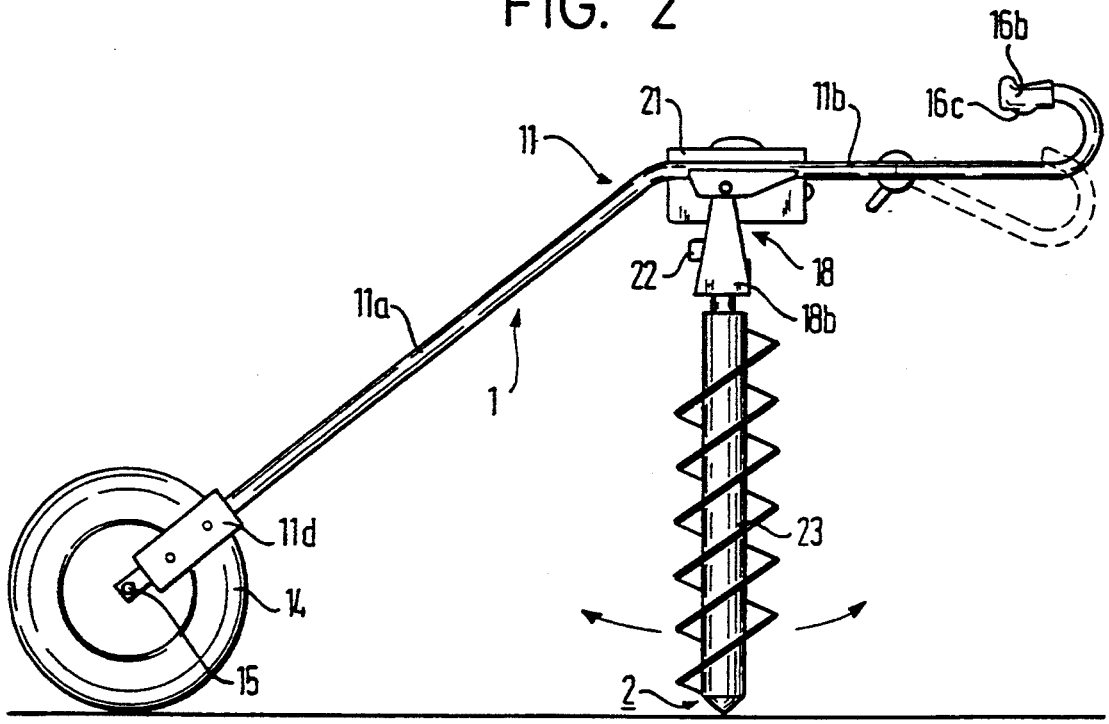
FIG. 2 shows a side view of the invention represented in FIG. 1.

In FIGS. 1 and 2, (1) signifies collectively a ground-boring device with a ground auger, which is referred to collectively as (2). The ground auger (2) includes an engine (21), customarily a combustion engine, which is coupled across a transmission (22) with a boring spindle (23) in the form of a lengthwise extended boring screw. The ground auger (2) can be a ground auger of a customary type, which can be operated either on its own with two straps by two service people, or which can also be provided with two handgrips to be used as a one-man implement.

In accordance with the present invention, it is nevertheless provided for, that the ground auger (2) be operated in the ground-boring device referred to collectively as (1). This essentially consists of a chassis, formed by a framework and a travelling gear. The framework includes two longitudinal bars (11) running essentially in its longitudinal direction, which are connected to each other in the vicinity of their ends by means of crossbars (12, 13). A wheel (14) is arranged on the one end of the framework, by means of an axle (15) located between the bars; emanating from here, assuming the device according to the invention is in its intended working position, the two longitudinal bars (11) initially run diagonally upward in part (**11*a*) and then continue in an essentially horizontally running second part (11*b*), as may be recognized from the side view in FIG. 2**.

A seating device (18) is mounted by means of bolts (**19*a*, 19*b*) at the parts (11*b*) of the longitudinal bars (11) in the upper region of the framework formed by the two parts (11*b*) of the longitudinal bars (11); this seating device is designed in the form of a console with a middle part (18*a*), offset downward in relation to the mounting bolts (19*a*, 19*b*) by means of side legs (18*b*), whereby the engine-transmission unit (21, 22) of the ground auger (2) can be flange mounted to the middle part (18*a*) of the seating device (18**) by means of screws.

Two handgrips (**16*a*, 16*b*), attached onto grip ends (11*c*) are attached by means of locking connections (17) on the ends of the second parts (11*b*) of the longitudinal bars (11) forming the upper region of the framework, such that they form an extrusion of the longitudinal bars (11). The locking connections (17) consist of a clamping screw actuated by means of a locking handle (17*b*) and a toothed lock washer (17*a*), provided with a toothed wheel work, and corresponding counter teeth at the ends of the bar parts (11***b*) or handle pieces (11*c*), through which can be produced an interlocking yet adjustable connection between the grip ends (11*c*) and the two parts (11*b*) of the longitudinal bars (11), through which is made possible a height adjustment of the handgrips (16*a*, 16*b*).

The customary actuation elements (16*c*), necessary for operation of the ground auger (2), are accommodated in the handgrip (16*b*); the actuation elements are coupled to the ground auger (2) across service controls, which themselves are not represented.

A seating device for one or more weights (11*d*) per each longitudinal bar is provided on the ends of the longitudinal bars (11) associated with the wheel (14) in order to increase the weight at this end.

To operate the ground auger, the service person grabs the two handgrips (16*a*, 16*b*), and, with the boring spindle (23) lifted up from the ground's surface, can comfortably convey the ground auger to a desired location, much like a push cart; this is also possible without difficulty or undue exertion in difficult terrain or even on slopes.

In order to introduce a bored hole into the ground, the tip of the boring spindle (23) is then set on the ground, whereby the boring spindle (23) can hang freely downward in a vertical position with respect to the longitudinal axis of the framework, on account of the floating mount of the seating device (18), at the longitudinal bars (11) by means of the bolts (19*a*, 19*b*). By means of actuating the operating control (16*c*) the engine (21) of the ground auger is then accelerated and by this means the boring spindle (23) set in turning motion across the transmission (22) such that the spindle can penetrate into the ground under the ground auger's own weight and, if necessary, by means of a light pressure on the two handgrips (16*a*, 16*b*).

The floating mount of the seating device (18), carrying the engine-transmission unit (21, 22) of the ground auger (2), by means of the two mounting bolts (19*a*, 19*b*) permits a swinging of the ground auger (2) in relation to the longitudinal direction of the framework with respect to the longitudinal bars (11), such that the angle which changes with penetration of the boring spindle (23) into the ground in relationship with the longitudinal bars (11) can be accommodated. After the assigned hole depth has been reached, the boring spindle (23) can easily be again lifted out of the hole using the two handgrips (16*a*, 16*b*), whereby the lever formed by means of the longitudinal bars (11) proves useful.

Using the locking connection (17), it is possible to adapt the handgrips (16*a*, 16*b*) to various body heights or to differing lengths of the boring spindle (23), whereby a dependable interlocking connection is created by means of the tooth system.

The additional weights (11*d*) provided on the ends of the longitudinal bars (11) associated with the wheel (14), which are preferably securely connected to the longitudinal bars (11), through the use of screws, or which can also be clamped on the bars, increase the weight at this end, such that with pressure on the handgrips (16*a*, 16*b*) for introducing a bored hole into the ground, a lifting up of the wheel (14) is avoided.

For the present preferred embodiment, the grip ends (11*c*) and the handgrips (16*a*, 16*b*) are identical to the handgrips provided for operation of the ground auger (2) by an individual person, as they are furnished for instance as a standard product from certain fabricators. On the one hand, this limits a necessary expenditure, because the operating controls (16*c*) are namely easy to provide for, while, on the other hand, this enables an operation of the ground auger (2) as a one-man implement, if desired.

In a departure from the preferred embodiment described above, represented in the figures and distinguished by means of its particular simplicity and limited weight, two wheels can be provided on the outer sides of the longitudinal bars (11), for instance, in place of a single wheel (14); this can be particularly advantageous on flat terrain. For operation of a two-wheeled embodiment of this type on rough terrain, it is advantageous if the seating device (18) permits a swinging or floating of the boring spindle (23) in a crosswise direction as well, perhaps by means of an intermediate added rubber element. In addition, it can also be provided for that the mounting bolts (19*a*, 19*b*) may be relocated in holes in a longitudinal direction on the diagonally running part of the longitudinal bars (11), or that they can be arranged in a slide which is movable in a longitudinal direction on the diagonally running part of the longitudinal bars (11), such that the seating device (18) is mountable at heights corresponding to various boring spindle lengths.

It can also be advantageous to provide buffers in order to limit a swinging of the seating device (18) backwards in the direction of the handgrips (16*a*, 16*b*) and/or in a crosswise direction. Likewise advantageous is a holding device, perhaps in the form of a belt, by which the boring spindle (23) can be held in a collapsed position for transport between the two longitudinal bars (11). Finally, supports can be provided, in the region of the ends of the longitudinal bars (11) associated with the handgrips (16*a*, 16*b*) for instance, which permit a parking of the device according to the invention in a manner similar to a push cart.

Having described the invention, many modifications thereto will become apparent to those skilled in the art to which it pertains without deviation from the spirit of the invention as defined by the scope of the appended claims.

1. A ground-boring device comprising:

a framework including at one end, a wheel for travelling of the framework and at an opposite end, a handgrip arrangement located, during operation of the device, at a gripping level of a service person, a ground auger mounted by said framework adjacent to said other end of said framework, said ground auger having a boring spindle and an engine-transmission unit for driving said boring spindle, and a seating device for mounting of said engine-transmission unit of said ground auger along said framework at a horizontal distance from said wheel and at a height vertically above said wheel, said handgrip arrangement being arranged such that said boring spindle operates substantially vertically by said seating device permitting a swinging of said ground auger in relation to said framework during penetration of said ground auger into the ground.

2. Device according to claim 1, wherein said wheel is arranged on an end of said framework situated opposite the end with the handgrip arrangement, and said seating device is located in a middle part of the framework, between said wheel and said handgrip arrangement.

3. Device according to claim 2, wherein said framework is formed by two longitudinal bars, which in their longitudinal direction run diagonally upwardly from said wheel to said handgrip arrangement and which are connected to each other by crossbars located adjacent to said wheel and to said handgrip arrangement, between which longitudinal bars in their upper region said seating device is mounted by mounting bolts to be rotatable around an axis running transverse to the framework.

4. Device according to claim 3, wherein said longitudinal bars include a first part running diagonally upwardly from said wheel, and a second part running horizontally to said handgrip arrangement, whereby said seating device is mounted in a region of said second part bordering on said first part.

5. Device according to claim 3, wherein said mounting bolts are relocatable in holes in a longitudinal direction to the diagonally running part of the longitudinal bars.

6. Device according to claim 2, wherein said wheel is arranged between the ends of said longitudinal bars by an axle.

7. Device according to claim 2, wherein said seating device permits a swinging of said ground auger in a transverse direction to said framework.

8. Device according to claim 2, wherein weights are provided on the end of the framework associated with said wheel.

9. Device according to claim 2, wherein said handgrip arrangement is adjustable to different heights.

10. Device according to claim 3, wherein said seating device is a console with a middle part for flange mounting of said engine-transmission unit of said ground auger, which is offset downwardly in relation to said mounting bolts by said legs.

11. A ground-boring device comprising:

a framework including at one end, a wheel for travelling of the framework and at an opposite end, a handgrip arrangement located, during operation of the device, at a gripping level of a service person, said handgrip arrangement being pivotally mounted on said framework at said opposite end of said framework for adjusting a height of said handgrip arrangement according to a depth of ground-boring and a height of a service person, a ground auger having a boring spindle and an engine-transmission unit for driving said boring spindle, and a seating device for mounting of said engine-transmission unit of said ground auger along said framework at a horizontal distance above said wheel, said handgrip arrangement being arranged such that said boring spindle operates substantially vertically by said seating device permitting a swinging of said ground auger in relation to said framework during penetration of said ground auger into the ground.

* * * * *